US006612085B2

(12) United States Patent
Edwards et al.

(10) Patent No.: US 6,612,085 B2
(45) Date of Patent: Sep. 2, 2003

(54) REINFORCING BARS FOR CONCRETE STRUCTURES

(75) Inventors: Christopher M. Edwards, Midland, MI (US); Edward L. D'Hooghe, Hulst (NL)

(73) Assignee: Dow Global Technologies Inc., Midland, MI (US)

( * ) Notice: Subject to any disclaimer, the term of this patent is extended or adjusted under 35 U.S.C. 154(b) by 109 days.

(21) Appl. No.: 09/756,450

(22) Filed: Jan. 8, 2001

(65) Prior Publication Data

US 2001/0023568 A1 Sep. 27, 2001

Related U.S. Application Data

(60) Provisional application No. 60/175,896, filed on Jan. 13, 2000.

(51) Int. Cl.[7] ..... E04C 5/07

(52) U.S. Cl. ..... 52/649.1; 52/740.1; 52/740.2; 52/740.3; 52/740.4; 52/740.5; 52/740.8; 52/740.9; 52/309.17; 52/396.02; 428/397

(58) Field of Search ..... 52/740.1, 740.2, 52/740.3, 740.4, 740.5, 740.6, 740.7, 740.8, 740.9, 309.15, 309.17, 309.1, 649.1, 694, 396.02; 428/377, 397

(56) References Cited

U.S. PATENT DOCUMENTS

| | | | | | |
|---|---|---|---|---|---|
| 1,364,182 | A | * | 1/1921 | Conkling | 52/740.2 |
| 2,375,361 | A | * | 5/1945 | Hillberg | 52/396.02 |
| 3,470,051 | A | * | 9/1969 | Meyer | 264/171.13 X |
| 3,475,876 | A | * | 11/1969 | Oroschakoff | 52/694 X |
| 3,742,106 | A | * | 6/1973 | Price | 264/131 |
| 3,993,726 | A | * | 11/1976 | Moyer | 264/171.13 X |
| 4,194,873 | A | | 3/1980 | Killmeyer | |
| 4,312,917 | A | * | 1/1982 | Hawley | 428/375 |
| 4,341,835 | A | | 7/1982 | MacDowell | |
| 4,376,834 | A | | 3/1983 | Goldwasser et al. | |
| 4,379,870 | A | | 4/1983 | Matsumoto | |
| 4,394,338 | A | * | 7/1983 | Fuwa | 264/135 |
| 4,620,401 | A | * | 11/1986 | L'Esperance et al. | 52/309.15 |
| 4,648,224 | A | | 3/1987 | Kitta et al. | |
| 4,706,430 | A | | 11/1987 | Sugita et al. | |
| 4,713,283 | A | * | 12/1987 | Cogswell et al. | 428/408 X |
| 4,728,387 | A | * | 3/1988 | Hilakos | 156/441 |
| 5,182,064 | A | | 1/1993 | Ishizuka et al. | |
| 5,362,542 | A | | 11/1994 | Ozawa et al. | |
| 5,433,419 | A | | 7/1995 | Murakami | |
| 5,437,899 | A | * | 8/1995 | Quigley | 428/35.7 |
| 5,447,793 | A | * | 9/1995 | Montsinger | 428/373 |
| 5,580,642 | A | | 12/1996 | Okamoto et al. | |
| 5,650,220 | A | * | 7/1997 | Greenwood | 428/300.7 |
| 5,725,954 | A | * | 3/1998 | Montsinger | 428/397 |
| 5,727,357 | A | * | 3/1998 | Arumugasaamy et al. | 52/740.1 |
| 5,763,042 | A | | 6/1998 | Kaiser et al. | |
| 5,763,043 | A | | 6/1998 | Porter et al. | |
| 5,798,067 | A | | 8/1998 | Long, Sr. | |
| 5,891,560 | A | | 4/1999 | Edwards et al. | |
| 5,894,003 | A | | 4/1999 | Lockwood | |
| 6,023,903 | A | * | 2/2000 | Stecker | 52/740.1 |

FOREIGN PATENT DOCUMENTS

| | | |
|---|---|---|
| DE | 3336765 | 7/1984 |
| EP | 0774552 | 5/1997 |
| EP | 0994223 | 4/2000 |
| FR | 2009094 | 1/1970 |
| JP | 111940 | 1/1989 |
| JP | 435512 | 5/2001 |
| JP | 462404 | 11/2001 |
| WO | 89/00493 | 1/1989 |
| WO | 96/16792 | 6/1996 |
| WO | 98/31891 | 7/1998 |

* cited by examiner

*Primary Examiner*—Laura A. Callo

(57) ABSTRACT

Reinforcing bars for concrete structures, are made from a composite of a depolymerizable and repolymerizable thermoplastic resin and longitudinally oriented reinforcing fibers. These reinforcing bars provide excellent tensile reinforcement, and do not exhibit the corrosion problems of conventional steel reinforcing bars. The rebars are readily formed into a great many shapes that are adapted to many specialized reinforcement requirements.

18 Claims, 4 Drawing Sheets

REINFORCING BARS FOR CONCRETE STRUCTURES

CROSS-REFERENCE STATEMENT

This application claims the benefit of U.S. Provisional Application No. 60/175,896, filed on Jan. 13, 2000.

STATEMENT REGARDING FEDERALLY SPONSORED RESEARCH OR DEVELOPMENT

The research and development leading to the subject matter disclosed herein was not federally sponsored.

BACKGROUND OF THE INVENTION

This invention relates to reinforcing materials for concrete and concrete structures so reinforced.

Concrete is one of the most common building materials. It is used in a wide variety of structures such as bridges, walls, floors, building supports, roadways, and runways among many others.

Concrete has excellent compressive strength, but is very poor in tensile strength. As a result, it is almost always necessary to reinforce a concrete structure if the structure will be exposed to tensile stresses such as those generated by a bending load. A very common way of providing this reinforcement is to incorporate metal (usually steel) reinforcing bars into the concrete. Steel reinforcing bars can provide a great improvement in tensile strength to the concrete structure.

Unfortunately, steel reinforcing bars corrode over time when exposed to water. This corrosion is accelerated if the steel is exposed to salts, as are often used in colder climates to melt snow and ice from the road surface. The concrete tends to provide some protection from water and salts, but over time cracks develop in the concrete and these materials are able to seep through the cracks to the embedded steel. As the steel begins to corrode, it expands due to the formation of rust layers. This expansion causes further cracking in the concrete, thereby accelerating the decay of the concrete structure.

To avoid this corrosion problem, certain pultruded composites have been tried. These composites include a thermoset resin that serves as a matrix into which longitudinal fibers, usually glass but sometimes of other materials, are embedded.

These thermoset composites solve the corrosion problem, but have other significant drawbacks. The most significant of these is that there is no practical way that these thermoset composites can be formed into a variety of shapes. Steel reinforcing bars are commonly bent, twisted or formed into rings in order to accommodate them to the needs of a particular construction project. This is often done on-site, but can also be done as part of the rebar manufacturing process. Pultruded thermoset composites are not formable once the thermosetting resin matrix is cured. Thus, on-site forming is not an option with the thermoset composites. Even in-factory forming is difficult. The pultrusion process is mainly adapted for making straight composites of constant cross-section. Any forming that is done must take place during a brief time window between the time the resin is applied to the reinforcing fibers and cured to a viscosity that it will not run off and the time the resin is fully cured. This short time window makes forming very difficult and expensive to accomplish for a thermoset composite.

A second major shortcoming of thermoset composites is that they are difficult to key into the concrete. Steel rebars often have raised or indented sections that are molded or stamped onto the surface of the bar. These sections permit the bar to be mechanically interlocked into the concrete. Thermoset composites, on the other hand, usually have a constant cross-section due to the nature of the pultrusion process. Post-forming methods for providing surface features such as stamping are not suitable because the thermoset composites tend to be brittle and have poor impact resistance. The stamping process tends to break the embedded fibers and weaken the composite. Sometimes overmoldings are used to provide a raised surface for keying into the concrete. However, the bond between the overmolding and the composite is often weaker than the concrete matrix and thus provides little benefit.

In addition, thermoset composites suffer from poor elongation (on the order of 1% at break), poor impact resistance and brittleness. They also are quite expensive, mainly due to slow production rates.

It would therefore be desirable to provide an alternative to steel and thermoset composite reinforcing bars for concrete structures.

SUMMARY OF THE INVENTION

In one aspect, this invention is a reinforcing bar (rebar) comprising a composite of a plurality of longitudinally oriented reinforcing fibers embedded in a matrix of a thermoplastic resin.

The reinforcing bar of this invention solves many of the problems associated with steel and thermoset composite rebars. The rebar of this invention does not corrode due to exposure to water and/or common salts. The rebar of the invention is readily formed into a great many shapes and configurations. As a result, it is easily formed into shapes that enable it to key into concrete, forming a mechanical interlock with the concrete that improves the reinforcing effect. This forming can be done easily on-site if desired. The reinforcing bar of the invention is often capable of being manufactured at higher rates than pultruded thermoset composites. As a result, the rebar of the invention can be less expensive and perform better than thermoset composite rebars.

In a second aspect, this invention is a concrete structure comprising a reinforcing bar embedded in a concrete matrix, said reinforcing bar comprising a composite of a plurality of longitudinally oriented reinforcing fibers embedded in a matrix of a thermoplastic resin.

DETAILED DESCRIPTION OF THE INVENTION

Figure 1A:
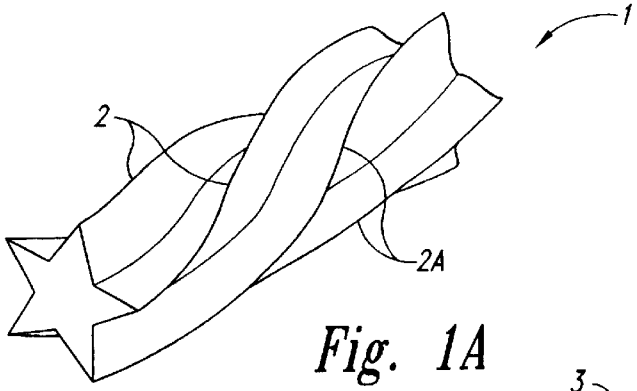
FIGS. 1A–1J, 2, 3A–3B and 4A–4C are isometric views of various embodiments of the invention.

The reinforcing bar of this invention comprises a composite of longitudinally oriented reinforcing fibers embedded in a matrix of a thermoplastic resin. It is conveniently made in a pultrusion process as described in U.S. Pat. No. 5,891,560 to Edwards et al.

The reinforcing fiber can be any strong, stiff fiber that is capable of being processed into a composite through a pultrusion process. Suitable fibers are well known and are commercially available. Glass, other ceramics, carbon, metal or high melting polymeric (such as aramid) fibers are suitable. Mixtures of different types of fibers can be used. Moreover, fibers of different types can be layered or interwoven with the composite in order to optimize certain desired properties. For example, glass fibers can be used in the interior regions of the composite and stiffer, more expensive fibers such as carbon fibers used in the exterior regions. This permits one to obtain the benefits of the high stiffness of the carbon fibers while reducing the overall fiber cost. In addition, the exterior carbon fibers provide additional protection for the glass fibers from the alkaline environment in the cement.

Suitable fibers are well known and commercially available. Fibers having diameters in the range of about 10 to 50 microns, preferably about 15–25 microns, are particularly suitable.

By "longitudinally oriented", it is meant that the reinforcing fibers extend essentially continuously throughout the entire length of the composite, and are aligned in the direction of pultrusion.

For most applications, glass is a preferred fiber due to its low cost, high strength and good stiffness.

As it is the fibers that mainly provide the desired reinforcing properties, the fiber content of the composite is preferably as high as can conveniently be made. The upper limit on fiber content is limited only by the ability of the thermoplastic resin to wet out the fibers and adhere them together to form an integral composite without significant void spaces. The fibers advantageously constitute at least 30 volume percent of the composite, preferably at least 50 volume percent and more preferably at least 65 volume percent.

The thermoplastic resin can be any that can be adapted for use in a pultrusion process to form the composite, and which does not undesirably react with the reinforcing fibers. However, the thermoplastic resin preferably has additional characteristics. The thermoplastic resin preferably is a rigid polymer, having a Shore A hardness of at least 95, a $T_g$ of not less than 50° C., or both. In addition, the thermoplastic resin preferably forms a low viscosity melt during the pultrusion process, so as to facilitate wetting out the reinforcing fibers. The thermoplastic resin preferably does not react with concrete in an undesirable way and is substantially inert to (i.e., does not react with, absorb, dissolve or significantly swell when exposed to) water and common salts. Among the useful thermoplastics are the so-called "engineering thermoplastics", including polystyrene, polyvinyl chloride, ethylene vinyl acetate, ethylene vinyl alcohol, polybutylene terephthalate, polyethylene terephthalate, acrylonitrile-styrene-acrylic, ABS (acrylonitrile-butadiene-styrene), polycarbonate, polypropylene and aramid resins, and blends thereof.

A particularly suitable thermoplastic resin is a depolymerizable and repolymerizable thermoplastic (DRTP). Examples of these are rigid thermoplastic polyurethanes or polyureas (both referred to herein as a "TPUs"). TPUs have the property of partially depolymerizing when heated due in part to the presence of residual polymerization catalyst. The catalyst is typically hydrolytically- and thermally-stable and is "live" in the sense that it is not inactivated once the TPU has been polymerized. This depolymerization allows the TPU to exhibit a particularly low melt viscosity, which enhances wet-out of the fibers. Upon cooling, the polyurethane repolymerizes to again form a high molecular weight polymer.

In addition, TPUs tend to form particularly strong adhesive bonds to concrete, compared to those formed by less polar resins such as polypropylene.

Suitable thermoplastic polyurethanes are described, for example, in U.S. Pat. No. 4,376,834 to Goldwasser et al. Fiber-reinforced thermoplastic composites suitable for use in the invention and which are made using such rigid TPUs are described in U.S. Pat. No. 5,891,560 to Edwards et al.

The composites described in U.S. Pat. No. 5,891,560 include a continuous phase which is advantageously a polyurethane or polyurea (or corresponding thiourethane or thiourea) impregnated with at least 30 percent by volume of reinforcing fibers that extend through the length of the composite. The general pultrusion process described in U.S. Pat. No. 5,891,560 includes the steps of pulling a fiber bundle through a preheat station a fiber pretension unit, an impregnation unit, a consolidation unit that includes a die which shapes the composite to its finished shape, and a cooling die. The pulling is advantageously accomplished using a haul off apparatus, such as a caterpillar-type haul off machine. Additional shaping or post-forming processes can be added as needed.

As described in U.S. Pat. No. 5,891,560, the preferred continuous phase polymer is a thermoplastic polyurethane or polyurea made by reacting approximately stoichiometric amounts of (a) a polyisocyanate that preferably has two isocyanate groups per molecule, (b) a chain extender, and optionally (c) a high equivalent weight (i.e., above 700 to about 4000 eq. wt.) material containing two or more isocyanate-reactive groups. By "chain extender", it is meant a compound having two isocyanate-reactive groups per molecule and a molecular weight of up to about 500, preferably up to about 200. Suitable isocyanate-reactive groups include hydroxyl, thiol, primary amine and secondary amine groups, with hydroxyl, primary and secondary amine groups being preferred and hydroxyl groups being particularly preferred.

Preferred TPUs are rigid, having a glass transition temperature ($T_g$) of at least 50° C. and a hard segment content (defined as the proportion of the weight of the TPU that is made up of chain extender and polyisocyanate residues) of at least 75%. Rigid thermoplastic polyurethanes are commercially available under the trade name ISOPLAST® engineering thermoplastic polyurethanes. ISOPLAST is a registered trademark of The Dow Chemical Company.

"Soft" polyurethanes having a Shore A hardness of 95 or less or a $T_g$ of 25° C. or less can be used, but tend to form a more flexible composite. Thus, "soft" polyurethanes are preferably used as a blend with a rigid thermoplastic polyurethane. The "soft" polyurethane is generally used in a proportion sufficient to increase the elongation of the composite (in the direction of the orientation of the fibers). This purpose is generally achieved when the "soft" polyurethane constitutes 50% or less by weight of the blend, preferably 25% or less.

The preferred DRTP can be blended with minor amounts (i.e., 50% by weight or less) of other thermoplastics, such as polystyrene, polyvinyl chloride, ethylene vinyl acetate, ethylene vinyl alcohol, polybutylene terephthalate, polyethylene terephthalate, acrylonitrile-styrene-acrylic, ABS (acrylonitrile-butadiene-styrene), polycarbonate, polypropylene and aramid resins. If necessary, compatibilizers can be included in the blend to prevent the polymers from phase separating.

The fiber-reinforced composite is formed into a rebar. In general, the rebar has a high aspect ratio (ratio of length to largest cross-sectional dimension). Aspect ratios of about 20 to 250 are common. The largest cross-sectional dimension of the rebar will of course vary considerably depending on the particular structure being reinforced. Typically, the largest cross-sectional dimension will range from ¼ inch to three inches or more (0.6 cm to 7.5 cm), and more typically range from about ½ inch to about 2 inches (about 1.2 cm to about 5 cm).

The rebar is also preferably shaped with some curvature, bending and/or variation of its cross-section along its length, so as to be capable of mechanically interlocking with the concrete. This shaping can be done on-line as part of the process of forming the rebar or can be done in some subsequent operation, including an on-site operation. Because the composite is readily formable, the rebar of the invention can assume a wide variety of configurations. Some of those configurations are exemplified in FIGS. 1A–1J.

Figure 1B:
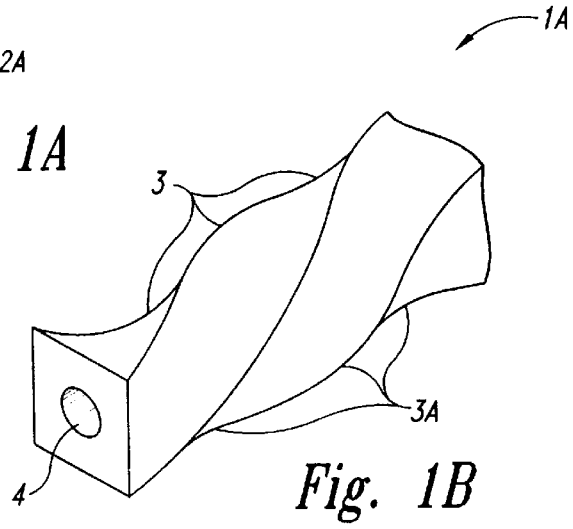

One way to provide for mechanical keying into the concrete is to form a spiraled rebar having any non-circular cross-section. FIGS. 1A and 1B illustrate this concept. In FIGS. 1A and 1 B, reinforcing bars 1 and 1A have, respectively, star-shaped and square cross-sections in which the orientation of the cross-sectional shape spirals along the length of the rebar. Because the spiraled cross-section is not circular, rebars 1 and 1A have surfaces that undulate along the length of the rebars, as shown by reference numerals 2 and 2A in FIG. 1A and reference numerals 3 and 3A in FIG. 1B. The undulating surface provides for mechanical interlocking with the concrete. This effect can be obtained by pultruding any cross-sectional shape except a circle, and either twisting the pultruded mass after it exits the die or rotating the die during the pultrusion process. Thus, the cross-section can be, e.g., an ellipse, an oval or any regular or irregular polygon. It is also possible, and sometimes preferable, to fabricate a spiraled rebar that comprises both left- and right-handed spirals.

Figure 1C:
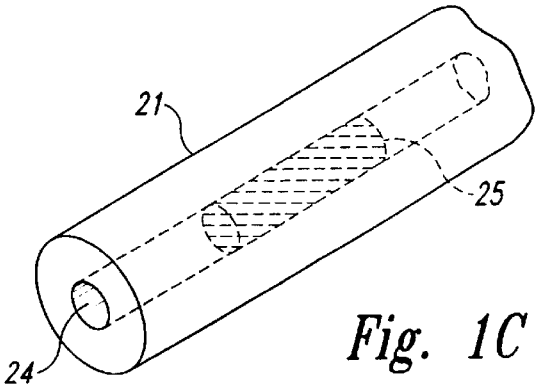
Figure 1D:
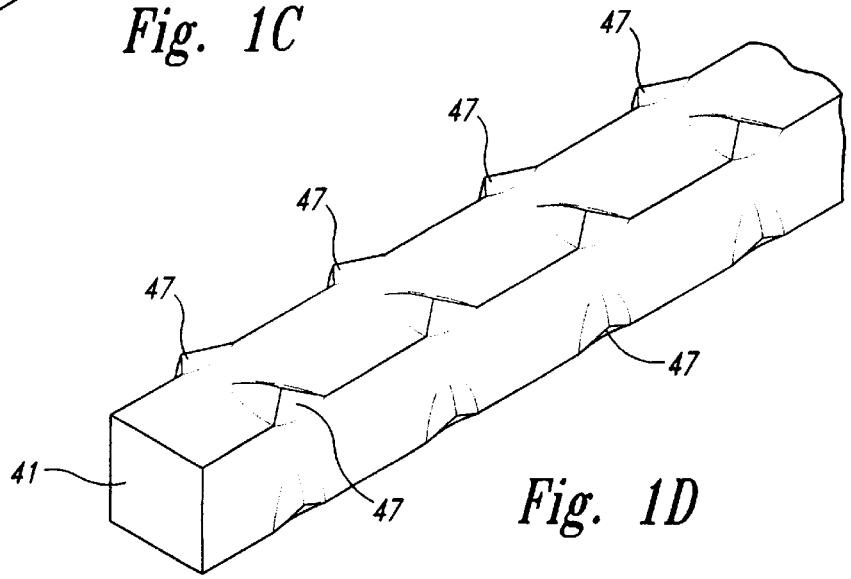
Figure 1E:
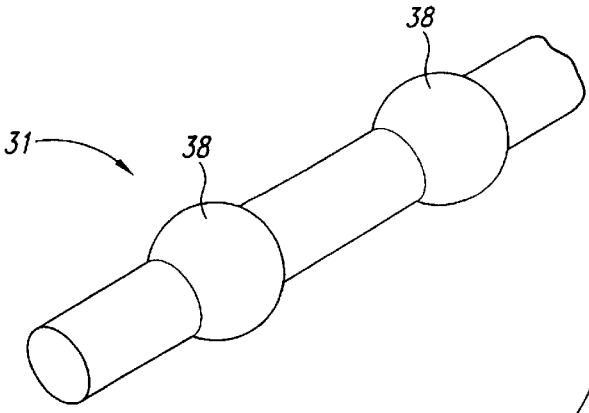
Figure 1F:
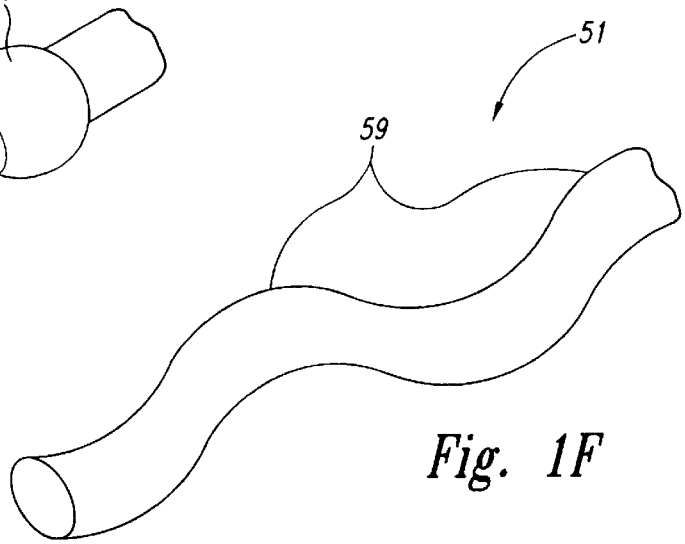
Figure 1G:
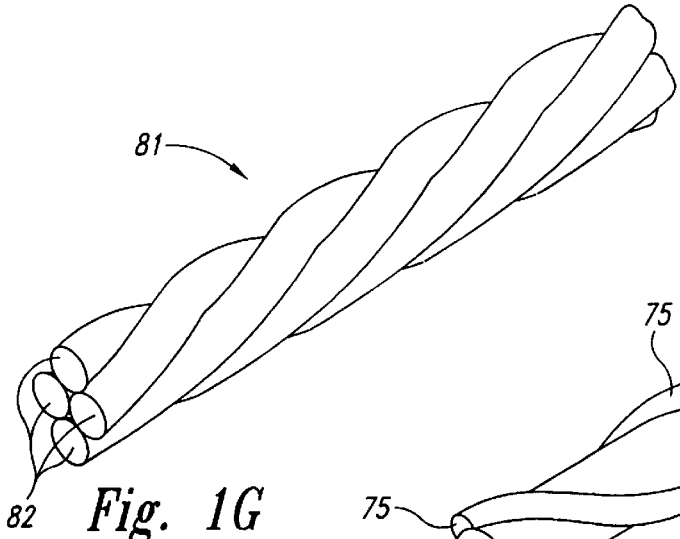

Twisting two or more individual pultruded sections to form a thicker rebar can achieve a similar effect, as shown in FIG. 1G. In FIG. 1G, rebar 81 is made up of four smaller strands 82 of fiber reinforced composite, which are twisted together. The twisting step can be performed on-line during the pultrusion step, while the thermoplastic resin is still at a temperature such that the pultruded strands 82 can be thermoformed. Alternatively, strands 82 can be re-heated and twisted to form rebar 81 separately from the pultrusion process. The number of smaller strands can of course vary considerably, e.g. from 2 to 12 or more, depending on the desired thickness of rebar 81 and that of the individual strands 82. Another way of achieving a similar rebar is to braid or weave, rather than to simply twist, individual strands 82.

FIG. 1B shows another optional feature, hole 4 that traverses the length of reinforcing bar 1A to form a hollow piece. Hole 4 can be provided, for example, to produce a lighter weight reinforcing bar that has a greater circumference to cross-sectional area ratio, which would be advantageous where greater chemical keying of the surface to the concrete is important. A hollow reinforcing bar of this type can be heated and easily crimped in order to bend it or to provide surface irregularities for mechanical interlocking into the concrete. Alternatively, hole 4 can be filled with various materials in order to achieve particular desired product characteristics. For example, hole 4 can be filled with a thermoplastic or thermoset resin, such as off-spec or recycled resin, various fillers such as glass, magnetic, other metallic particles, wood, ceramic or metallic (e.g., steel) rods, and the like.

Figure 1H:
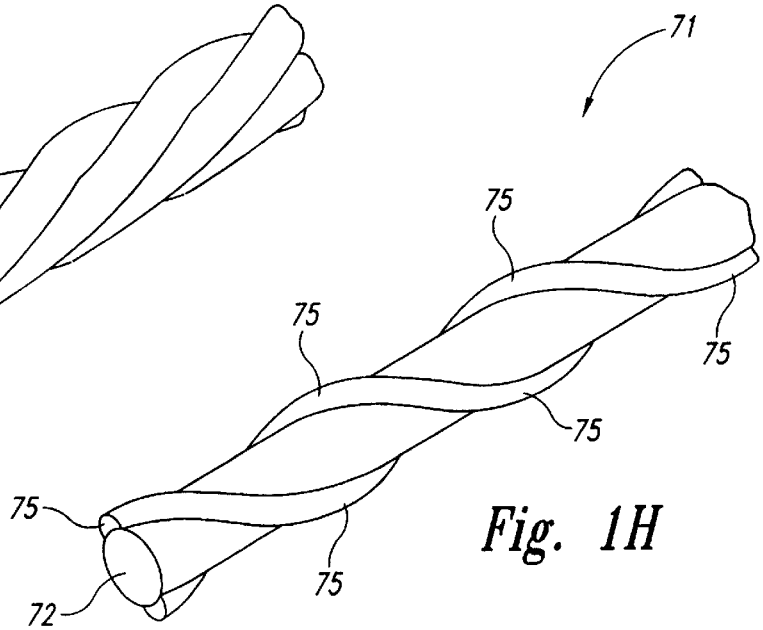
Figure 1I:
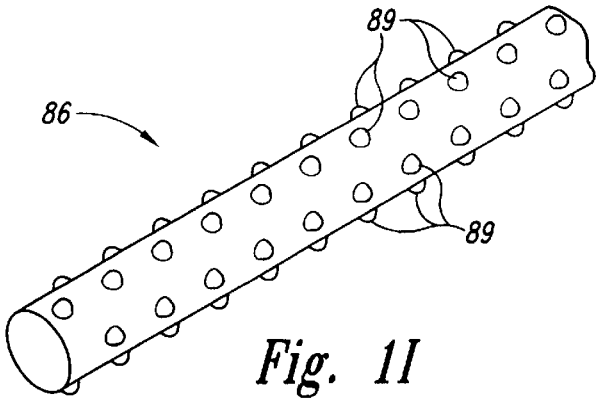
Figure 1J:
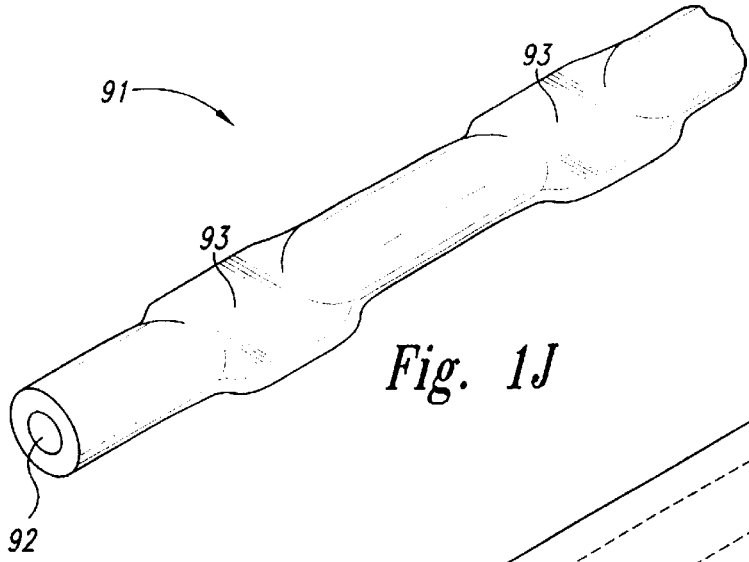

Hollow rebars of the type shown in FIGS. 1B, 1C and 1J are easily prepared using a circular die in the consolidation unit of the pultrusion process. Filler materials can be injection molded into the resulting hole when desired. Alternatively, the composite can be pultruded directly over a core of filler material.

A resinous matrix having short (preferably less than 2 inches (less than 5 cm), more preferably less than ½ inch (less than 1.3 cm) in length), randomly oriented reinforcing particles is a particularly suitable type of filler material, as it provides for omnidirectional strengthening of the rebar. Another preferred type of filler material is a metal, or a resinous or other matrix containing metal fibers or particles. It is often necessary to locate rebars in a concrete structure, as, for example, when repairs are to be made. Metallic filler materials enable the rebar to be detected using ordinary metal detectors, in the same way as steel rebars are currently located.

Another third preferred type of filler material is a resinous or other matrix containing magnetic particles. When exposed to a strong magnetic field, the magnetic particles will become heated. This provides a convenient method for softening the rebar for on-site forming. The heated magnetic particles transfer heat to the thermoplastic resin, thereby causing it to soften enough that the rebar can be formed into the required shape. Magnetic particles include barium ferrite and strontium ferrite, iron oxides such as $Fe_3O_4$ and $Fe_2O_3$, alloys of iron, aluminum, nickel, cobalt, copper, carbon, titanium, manganese, chromium, tungsten, platinum, silver, molybdenum, vanadium, or niobium or combinations thereof such as powdered alnico alloys, cunico alloys, chromium steel, cobalt steel, carbon steel, and tungsten steel. The size of the magnetizable particles is generally in the range of submicron to mm. A commercial example of a ferromagnetically filled thermoplastic is EMAWELD™ interlayer (a trademark of Ashland Chemical Co.).

As shown in FIG. 1C, hole 24 may be filled only at preselected portions of its length in order to provide localized strengthening without unduly increasing weight. In FIG. 1C, hole 24 extends longitudinally throughout the length of rebar 21. Filler material 25 fills the middle portion of hole 24, but hole 24 is otherwise unfilled. Filler material 25 thus provides increased shear strength at the center of the length of rebar 21, where the shear stresses are commonly the greatest. This embodiment of the invention is particularly useful as a dowel bar, as described below.

The rebar shown in FIG. 1J illustrates another way to provide for mechanical interlocking with the concrete. In FIG. 1J, rebar 91 has hole 92 and flattened areas 93 that are conveniently made by crimping or crushing. In addition to providing mechanical interlocking with the concrete, the flattened areas 93 provide spots at which rebar 91 can be more easily bent or shaped. As shown in FIG. 1J, rebar 91 may be hollow, but that is not necessary.

Conversely, providing areas of increased cross-section as shown in FIG. 1E can create mechanical interlocking with the concrete. Areas 38 of rebar 31 in FIG. 1E have larger cross-sectional diameters than the remaining portions. This can be accomplished by overmolding a thermoplastic or thermoset resin onto the rebar, especially a resin containing randomly oriented reinforcing fibers. However, overmolding is a less preferred process because the adhesion of the overmold to the underlying composite is sometimes inadequate. Another way of accomplishing this is to employ a die of variable diameter in the pultrusion process. By periodically increasing the diameter of the die, areas of increased diameter can be formed on the rebar.

In FIG. 1D, offset portions 47 of rebar 41 create mechanical interlocking with the concrete. This can be done by crimping or thermoforming the comers of a rebar having a polygonal cross-section. In FIG. 1F, mechanical interlocking is created by introducing curves 59 into rebar 51. Curves 59 are shown as generally sinusoidal curves in FIG. 1F, but localized curves, sharper bends and curves of other patterns are equally useful. In addition to providing sites for mechanically interlocking the rebar into the concrete, these curves tend to provide the rebar with somewhat increased elongation. When a load is applied to a curved rebar, the rebar will not break until at least some of the applied force is dissipated in straightening the bar.

FIG. 1H illustrates yet another way to provide raised surface features for interlocking with the concrete. In FIG. 1H, rebar 71 has spiraled windings 75, which may be overmolded or pultruded onto the main body 72 of rebar 71. In a preferred embodiment, both the main body 72 and windings 75 are pultruded composites of a thermoplastic resin and longitudinal reinforcing fibers as described before. Rebar 71 is conveniently made by separately extruding main body 72 and windings 75 and wrapping windings 75 about main body 72 at an elevated temperature so that the windings are thermoformable and adhere to main body 72. Another way of making rebar 71 is to use a shaped, rotating die to make main body 72 and windings 75 together in a single step. A third way is to use a shaped but stationary die to make main body 72 and winding 75 in a single step, and then to twist the pultruded part, either on-line or in a separate process step.

Yet another way to provide for mechanical interlocking is to provide raised surface dimples as shown in FIG. 1I. As shown, rebar 86 has a plurality of dimples 89 that protrude from the main surface. Again, this can be done in a variety of ways. A simple way is to partially embed a suitable particulate into the surface of reinforcing rebar 86 while the thermoplastic resin is in a softened state. Suitable particulates include thermoplastic or thermoset resins, glass or other ceramic materials, metal particles, sand and other minerals, and the like.

Figure 2:
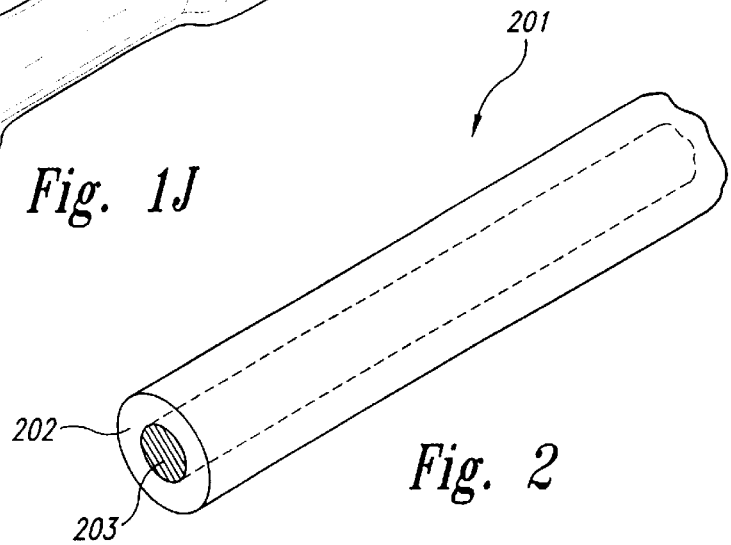

In another embodiment illustrated in FIG. 2, rebar 201 according the invention includes core 203 and sheathing 202. Core 203 is suitably steel or other metal. Sheathing 202 is a composite of a thermoplastic resin and longitudinal reinforcing fibers as described before. The thickness of sheathing 202 relative to that of rebar 201 as a whole can vary according to the particular application in which it is used. A relatively thick core 203 provides rebar 201 with reinforcing properties very comparable to those of a conventional steel rebar, with the added benefit that sheathing 202 protects core 203 from exposure to water, salts and other corrosive materials. A relatively thinner core 203 provides less strength, but permits rebar 201 to be located in a concrete structure using conventional metal detectors.

The reinforcing bar of the invention is easily fabricated into complex reinforcing structures if desired. This can be achieved in a number of ways that take advantage of the thermoformability of the reinforcing member.

Figure 3A:
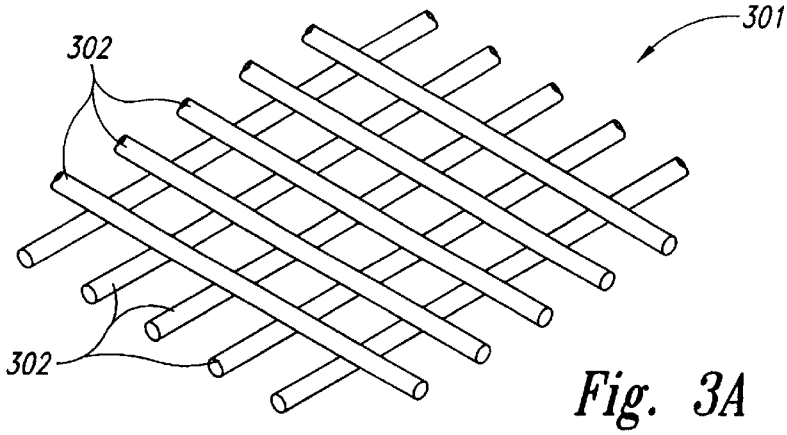

For example, FIG. 3A illustrates reinforcing grid 301 made from individual small diameter composite strands 302 of a DRTP and longitudinal reinforcing fibers as described before. The individual strands 302 are easily formed into a unitary grid by heating strands 302 at their intersection points so that the thermoplastic becomes softened and cause the individual strands to adhere together. Alternatively, the individual strands 302 can be woven together, again by heating the individual strands 302 so that the DRTP becomes softened and the strands thus become somewhat flexible. Alternatively, the individual strands can be adhered together with a suitable adhesive, such as a hot melt adhesive. Less preferably, mechanical means can be used to assemble strands 302 into grid 301.

Figure 3B:
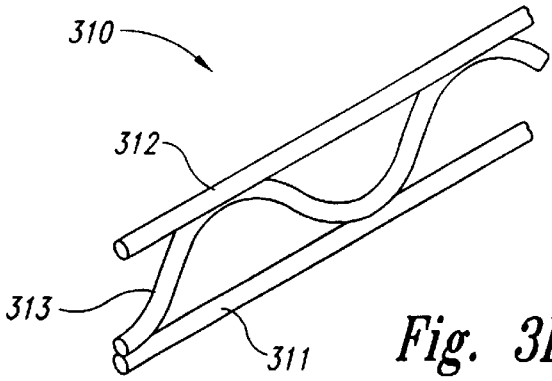

FIG. 3B illustrates a shear truss or similar assemblage made from the rebar of the invention. Shear truss 310 consists of straight rebars 311 and 312 and serpentine rebar 313. Rebars 311, 312 and 313 are readily joined at their intersections through the use of adhesives, welding or through the use of any type of mechanical connectors. Molded connectors can be formed to hold the individual members together, if desired. These connectors or bridges can be formed from the same fiber-reinforced composite as are reinforcing bars 311, 312 and 313. Alternatively, the connectors or bridges can be made of a non-reinforced thermoplastic or thermosetting resin.

It will be apparent that in addition to shear truss 310 a large number of complex reinforcing structures can be prepared in an analogous manner, as needed for a particular job.

Figure 4A:
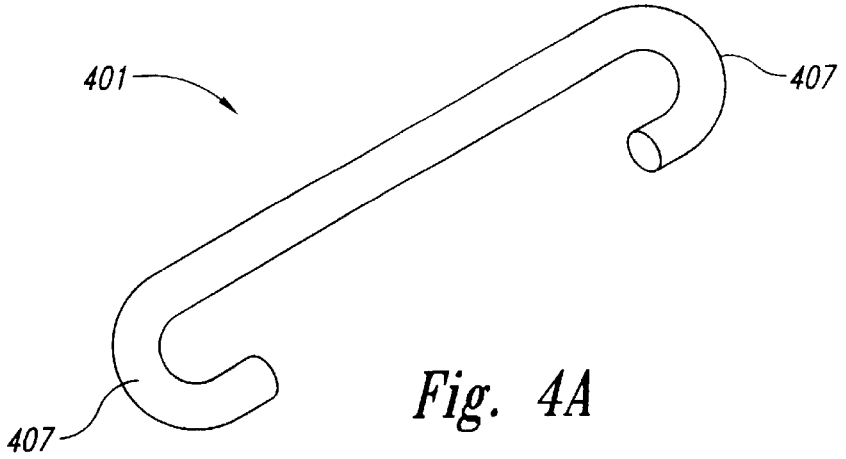

Fiber-reinforced rebars of the invention are easily fabricated to create integral connecting features. FIG. 4A, for example, illustrates rebar 401 having terminal hooks 407 that can be used to connect rebar 401 to other rebars or other structural components. Alternatively, rebar 408 of the invention can have deformed ends 409 as shown in FIG. 4B to facilitate anchoring the member through a wedging action.

Figure 4B:
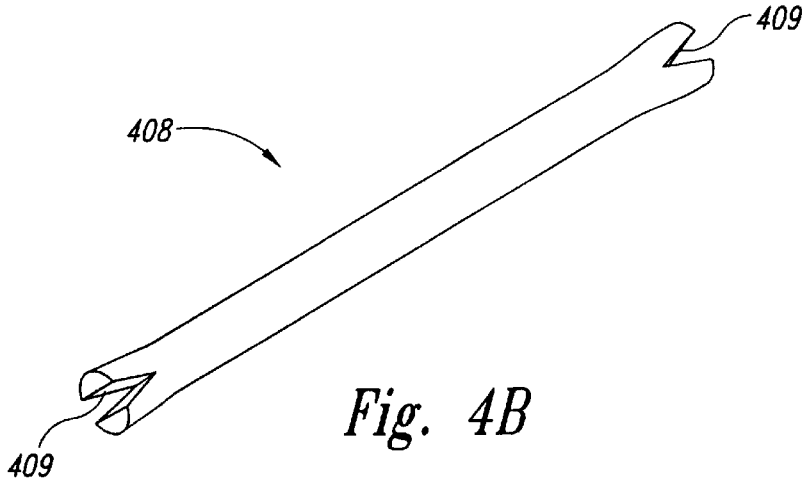

Curves of the type illustrated in FIG. 4A and deformations as illustrated in FIG. 4B are conveniently introduced in a post-forming process by reheating the fiber-reinforced composite to a temperature at which the thermoplastic resin softens, forming the softened composite into the desired shape, and then cooling the composite so that the thermoplastic rehardens. In like manner, looped rebars can be made, such as circular or elliptical rebars.

Figure 4C:
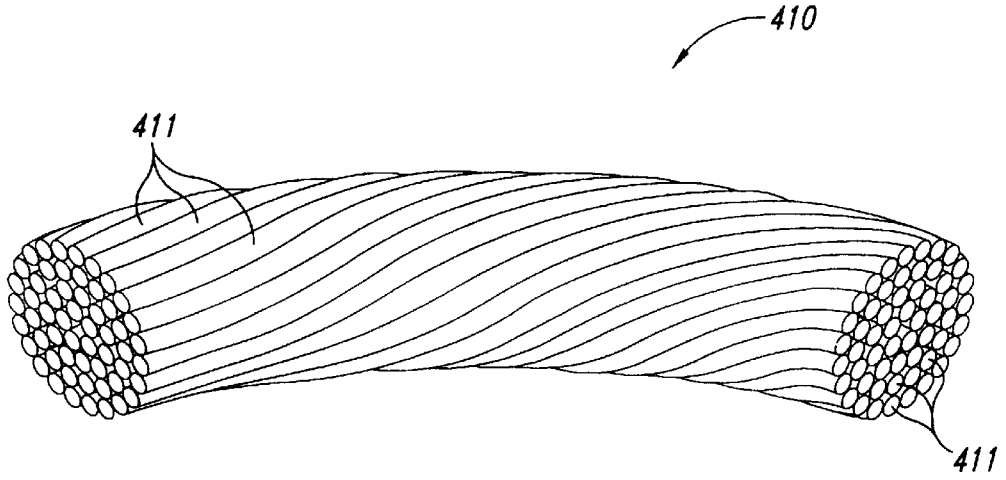

It will be noted that simply bending or curving a rebar of the invention will tend to cause a certain amount of fiber buckling or distortion. This is because the radius of curvature on the inside of the bend or curve is smaller than that of the outside of the curve. The bending or curving process therefore puts compressive stresses onto the fibers on the inside of the bend or curve and tensile stresses on those on the outside of the bend or curve. This problem can be largely or wholly overcome by twisting the composite as it is bent or curved. This permits all fibers to experience nearly the same tensile and compressive stresses, thereby reducing or eliminating the buckling or distortion. The orientation of the fibers in such a twisted and bent rebar is illustrated in FIG. 4C. Rebar 410 includes fibers 411 that are twisted along the longitudinal extension of rebar 410. This enables all of fibers 411 to experience like compressive and tensile stresses. The longitudinal twisting also provides greater apparent ductility in the composite.

A specialized form of rebar that is used in some concrete structures is known as a dowel bar. A dowel bar is often used, for example, in concrete highways to connect adjoining concrete roadway surface panels. The dowel bar "bridges" the adjoining panels, with one end of the dowel bar being embedded in one of the panels and the other end embedded in the second of the panels. Unlike many other types of rebars, it is often desirable that the dowel bar is able to move with respect to the panels. In a highway, this permits the individual road panels to move slightly with respect to each other to accommodate thermal expansion and contraction.

The rebar of this invention is easily adapted to serve as a dowel bar. For use as a dowel bar, it is preferred that the bar does not mechanically interlock with the concrete, so dowel bars made in accordance with the invention preferably are straight pieces with uniform cross-section along their length. Because the preferred TPUs tend to adhere strongly to concrete, it is preferred to apply a coating that does not adhere well to concrete. A coating of any non-polar resin, such as polytetrafluoroethylene or polypropylene, is suitable for this purpose. As the dowel bar is subjected to the greatest shear forces at the point where the adjoining concrete panels meet, the rebar of the invention can be further reinforced at the corresponding section of the rebar. This can be done, for example, by forming a hollow rebar in which the central core is filled near the middle of the length of the rebar, as shown in FIG. 1C.

It will be appreciated that many other variations of the rebar of the invention can be made, according to the needs of a specific concrete structure in which it will be used. For example, the rebar may be mounted near the surface of the concrete by introducing a channel at the surface of the concrete and bonding the rebar into the channel. Such near surface mounted rods are useful in the upgrading and repair of existing structures.

The rebar of the invention is used in much the same manner as conventional steel rebars are used. The rebars are assembled into place, forming a skeleton or framework over which the concrete structure is formed. Individual rebars can be connected together in a variety of ways, including ties, clamps, welds, brackets, snap-on bridges or other connectors, glues, and the like, to hold them in place until the concrete is poured and hardens. In preferred embodiments, the concrete is poured over the skeleton or framework and permitted to harden.

As used herein, "concrete" is used in the usual sense of meaning a mixture of a particulate filler such as gravel, pebbles, sand, stone, slag or cinders in either mortar or cement. Suitable cements include hydraulic cements such as Portland cement, aluminous cement, and the like. The cement or concrete may contain other ingredients such as, for example, a plastic latex, hydration aids, curatives, and the like.

The rebar of the invention can also be used as an external reinforcement for a variety of types of structures. Because the rebar is easily thermoformable, bends can be made near the ends of a rebar, forming, for example, a rectangular shaped rebar. Such a rebar can be keyed into the surface of structure by imbedding the ends into the structure. In this manner, reinforcement can be applied across existing cracks in a structure to slow or prevent further crack propagation.

In addition to or separate from rebars, composite "mega-fibers" can be dispersed into a concrete mix to provide reinforcement for the concrete. These megafibers, if sufficiently large, can provide the strength provided by the rebar, while at the same time providing crack control that small fibers can provide.

What is claimed is:

1. A reinforced concrete structure comprising concrete and a reinforcing bar mechanically interlocking with the concrete, wherein the reinforcing bar has a plurality of longitudinally oriented reinforcing fibers embedded in a matrix of a thermoplastic resin, which thermoplastic resin is a depolymerizable and repolymerizable thermoplastic polyurethane or a thermoplastic polyurea having a $T_g$ of not less than 50° C. and a hard segment content of at least 75% and which reinforcing bar is further characterized by having:

a) a lengthwise spiraled portion and a polygonal cross-section; or b) longitudinal recesses with a circular cross-section; or c) a hollow along the length of the reinforcing bar and a circular cross-section; or d) areas of different cross-sections; or e) curves or bends along the length of the reinforcing bar; or f) intertwining composites; or g) a plurality of raised surface dimples on the reinforcing bar; or h) a plurality of flattened areas on the surface of the reinforcing bar to create mechanical interlocking; or i) a core surrounded by, and partially or totally extending the length of, the reinforcing bar, which core composes a thermoplastic resin, a thermoset resin, magnetic particles, a ceramic, wood, or a metal; or j) interconnecting reinforcing bars that form a unitary grid structure; or k) interconnecting reinforcing bars that form a shear truss structure; or l) terminal hooks; or m) deformed ends; or n) a combination of bends and twists.

2. The reinforced structure of claim 1, wherein said longitudinally oriented reinforcing fibers are continuous through the length of the reinforcing bar.

3. The reinforced structure of claim 1, wherein said longitudinally oriented reinforcing fibers are glass or carbon fibers.

4. The reinforced structure of claim 1, wherein said reinforcing bar has a polygonal cross-section and which contains at least one lengthwise spiraled portion.

5. The reinforced structure of claim 1, wherein said reinforcing bar is composed of a plurality of twisted, woven or braided strands of a composite of the thermoplastic and longitudinally oriented reinforcing fibers.

6. The reinforced structure of claim 1, wherein said reinforcing bar is curved or bent along the length of the reinforcing bar.

7. The reinforced structure of claim 1, wherein said reinforcing bar has a polygonal cross section having corners, and at least one of said corners are deformed at a plurality of places along the length of said rebar.

8. The reinforced structure of claim 1, wherein said reinforcing bar includes areas of different cross-sections.

9. The reinforced structure of claim 1, wherein said reinforcing bar is hollow.

10. The reinforced structure of claim 1, wherein said reinforcing bar contains a plurality of flattened areas.

11. The reinforced structure of claim 1 having wherein said reinforcing bar has a plurality of raised surface dimples.

12. The reinforced structure of claim 11 wherein said raised ace dimples are partially embedded particles of a thermoplastic or thermoset resin, a ceramic, a metal or a mineral.

13. The reinforced structure of claim 1 which contains reinforcing bars that are interconnected to form a unitary grid structure.

14. The reinforced structure of claim 1 which contains a plurality of reinforcing bars interconnected to form a unitary shear truss structure.

15. The reinforced structure of claim 1 wherein said reinforcing bar is substantially straight and includes an external coating that does not adhere to concrete.

16. The reinforced structure of claim 1 wherein said reinforcing bar includes at least one external raised winding twisted around and traversing the length of the reinforcing bar wherein at least one winding is a composite of a plurality of longitudinally oriented reinforcing fibers embedded in a matrix of a depolymerizable and repolymerizable thermoplastic polyurethane or thermoplastic polyurea having a $T_g$ of not less than 50° C. and a hard segment content of at least 75%.

17. A concrete structure comprising a reinforcing bar embedded in a concrete matrix, said reinforcing bar comprising a composite of a plurality of longitudinally oriented reinforcing fibers embedded in a matrix of a depolymerizable and repolymerizable thermoplastic polyurethane or a thermoplastic polyurea having a $T_g$ of not less than 50° C. and a hard segment content of at least 75%.

18. The concrete structure of claim 17, wherein the concrete matrix includes a cement or mortar, and a particulate filler.

* * * * *